US005622356A

United States Patent [19]

Duggan

[11] Patent Number: 5,622,356

[45] Date of Patent: Apr. 22, 1997

[54] POST PROTECTOR

[76] Inventor: James F. Duggan, 3541 Pebble Beach Dr., Farmers Branch, Tex. 75234

[21] Appl. No.: 502,823

[22] Filed: Jul. 14, 1995

[51] Int. Cl.[6] ..... E04H 17/00

[52] U.S. Cl. ..... 256/1; 256/19; 52/170; 52/736.4

[58] Field of Search ..... 256/1, 19, DIG. 5, 256/24; 47/25, 23, 33, 30 T, 24, 24 T; 52/169.14, 170, 736.4, 736.3, 741.11, 738.1

[56] References Cited

U.S. PATENT DOCUMENTS

| | | | |
|---|---|---|---|
| D. 162,243 | 2/1951 | Simmons . | |
| 405,658 | 6/1889 | Campany . | |
| 574,641 | 1/1897 | Streator . | |
| 761,721 | 6/1904 | Stanley | 52/736.4 |
| 985,681 | 2/1911 | Konopinski . | |
| 1,784,770 | 12/1930 | Wiley | 52/170 |
| 1,999,098 | 4/1935 | Hillyer et al. | 52/736.4 X |
| 3,350,822 | 11/1967 | Nachazel | 52/170 |
| 3,571,972 | 3/1971 | Carter, Jr. | 47/25 |
| 3,615,110 | 10/1971 | Fugate | 256/59 X |
| 3,704,004 | 11/1972 | Carter, Jr. | 256/1 |
| 4,038,802 | 8/1977 | Bajorek et al. | 52/738.1 X |
| 4,516,365 | 5/1985 | Chapman | 52/170 |
| 4,516,756 | 5/1985 | Beatty | 256/1 |
| 4,610,432 | 9/1986 | Lewis et al. | 256/1 X |
| 4,646,489 | 3/1987 | Feller et al. | 256/DIG. 5 X |
| 4,845,889 | 7/1989 | Taylor | 47/23 |
| 5,161,909 | 11/1992 | Crouse et al. | 403/391 |
| 5,178,369 | 1/1993 | Syx | 256/1 X |
| 5,203,817 | 4/1993 | Klumpjan | 256/19 X |
| 5,311,713 | 5/1994 | Goodrich | 52/301 |
| 5,369,925 | 12/1994 | Vargo | 52/736.4 X |
| 5,371,986 | 12/1994 | Guditis | 52/736.4 X |
| 5,480,126 | 1/1996 | Teasdale | 256/1 X |
| 5,503,371 | 4/1996 | Bies | 256/1 |

FOREIGN PATENT DOCUMENTS

| | | | |
|---|---|---|---|
| 2041694 | 11/1952 | Canada | 47/23 |
| 2442935 | 8/1980 | France . | |
| 2138859 | 10/1984 | United Kingdom | 256/1 |
| 2231345 | 11/1990 | United Kingdom . | |
| 9319266 | 9/1993 | WIPO | 256/DIG. 5 |

*Primary Examiner*—Harry C. Kim
*Attorney, Agent, or Firm*—Vinson & Elkins L.L.P.

[57] ABSTRACT

A post protector for protecting a fence post in a constructed fence from damage by lawn care tools such as lawn trimmers, mowers, or clippers. The post protector is three-paneled with a front panel, and a second and third panel attached to opposite edges of the front panel. The three panels are sized to have the approximately the same widths as the post to be protected. The second and third panel are bowed inward towards each other to provide spring pressure against a post positioned therebetween. A pointed piece is attached to the bottom edge of the front panel, and a flange is attached to the top edge of the front panel. In another embodiment of the invention, side molding pieces are attached to the second and third panel of the post protector and extend outward from the panels to protect adjacent fence boards.

15 Claims, 3 Drawing Sheets

FIG. 1
(PRIOR ART)
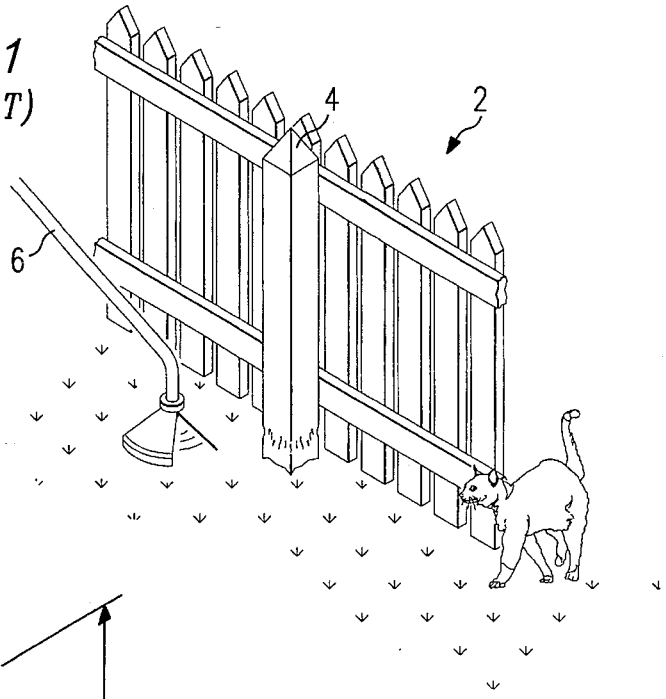
FIG. 2
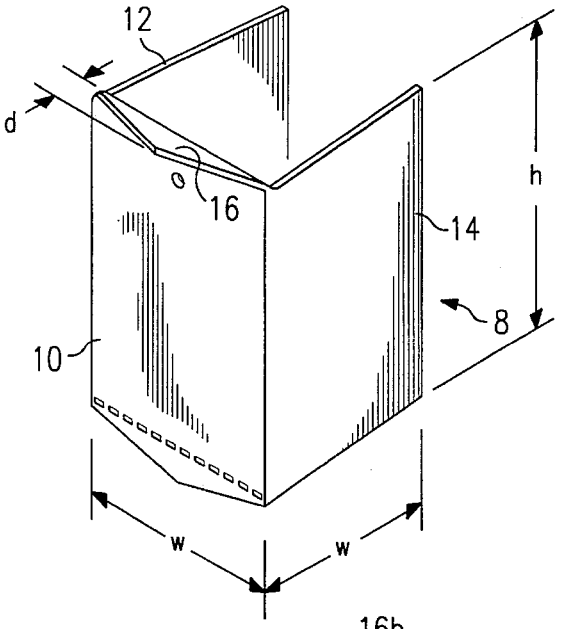
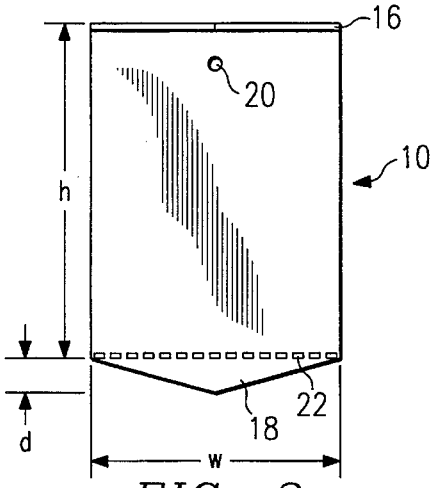
FIG. 3
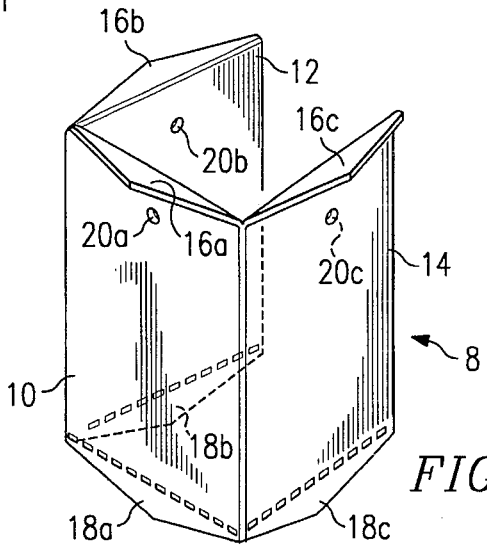
FIG. 4

POST PROTECTOR

This invention relates to an improved assembly and method for protecting a post from deterioration due to damage caused by lawn care tools such as lawn trimmers, mowers, or grass cutters.

BACKGROUND OF THE INVENTION

Many fences found in residential neighborhoods are constructed with a series of support fence posts, often 4×4 timbers, placed somewhat equidistantly from each other. Cross-members are horizontally attached to the fence posts, and slats or 1×4 fence boards are attached vertically to the cross-members. FIG. 1 illustrates a typical residential fence 2 with a 4×4 fence post 4 constructed in this manner. As illustrated in FIG. 1, the fence post 4 protrudes outward from the fence 2 and is thus susceptible to damage from lawn care tools. For example, FIG. 1 illustrates a grass trimmer 6, such as those sold under the registered trademark WEEDEATER, which uses a rotating nylon monofilament line to cut grass along a fence. Unfortunately, this line often strikes and damages the fence post because of the post's protruding position.

Deterioration to a fence post due to damage by lawn tools can pose threats to the integrity of an entire section of a fence. In addition, damage to a fence post is costly and more burdensome to repair than a single fence board, as the post is generally set in concrete. Thus, protection for a fence post from damage and deterioration is desirable and worth the cost and effort of installing a protection device.

Prior art devices for protection of fence posts or trees are cylindrical and are designed to surround a post or tree to be protected. For example, Goodrich U.S. Pat. No. 5,311,713 discloses a cylindrical casing to be placed completely around a utility pole before it is installed. Campany U.S. Pat. No. 405,658 also discloses a cylindrical pole protector that surrounds a pole. These devices are difficult if not impossible to use on a fence post that is already part of a constructed fence. As illustrated in FIG. 1, fence boards are typically positioned directly behind and to the sides of the fence posts with only a small space between the fence boards and fence post. It would thus be difficult to install a prior art device, which surrounds a post, onto a fence post. In addition, prior art devices which are not cylindrical are designed to be structural supports only and are inadequate for protecting against damage due to lawn care tools. For example, Chapman U.S. Pat. No. 4,516,365 discloses a post support member which fails to cover and protect the sides of a post.

Therefore, it is an object of the present invention to provide a device for protecting a fence post from deteriorating due to damage by lawn care tools, such as a grass trimmer, mower, or clippers.

It is a further object of the present invention to provide a device which is easily attached to a fence post which is already set in the ground.

It is a further object of the present invention to provide a device which can be attached to fence posts in varying types of ground cover.

It is a still further object of the present invention to provide a device which can be installed to protect a free-standing post as well as a fence post.

Other objects and advantages of the present invention will be apparent to those of ordinary skill in the art having reference to the following specification together with its drawings.

SUMMARY OF THE INVENTION

The invention is a three-paneled device of metal or hard, durable plastic. The front panel has a left edge with a first panel attached thereto and a right opposing edge with a second panel attached thereto such that the three panels form a C-shaped cross section. Each of the three panels is shaped to fit the width of the post to be protected. The second and third panels are inwardly biased toward each other so that, when placed on a post, the second and third panels exert pressure on opposite sides of the post to hold the device in place. A pointed piece is attached to the bottom edge of the front, and a flange is attached to the top edge. The flange provides a surface to exert downward pressure on the post protector and force the pointed piece into the ground. The device can be further secured to the post by a nail or screw attached through an opening in the front into the post. To protect a free-standing post, the front of a first device may be placed on one side of the post and the front of a second device placed on the opposite side with the second and third panels of the two devices overlapping.

In another embodiment of the invention, a curved side molding is attached to each of the first and second panels of the device such that a curved side of the molding extends between the panel of the device and the fence. The curved molding protects the fence from a lawn trimmer at locations adjacent to the post and prevents build-up of grass clippings in the hard to reach corners around posts.

BRIEF DESCRIPTION OF THE DRAWINGS

FIG. 1 illustrates a prior art perspective view of an unprotected fence post damaged by a lawn trimmer.

FIG. 2 illustrates a perspective view of a post protector of the present invention.

FIG. 3 illustrates a front elevated view of the post protector of the present invention.

FIG. 4 illustrates a perspective view of a second embodiment of the post protector of the present invention.

DETAILED DESCRIPTION OF THE PREFERRED EMBODIMENT

Figure 5:
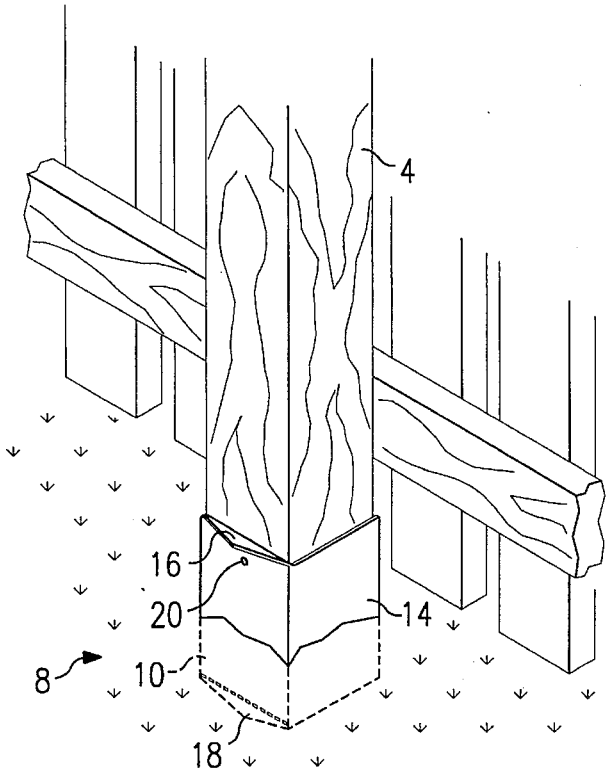
FIG. 5 illustrates a perspective view of the post protector of the present invention as it is normally installed on a fence post.

Referring now to FIGS. 2 and 3, a first embodiment of the present invention will be described. FIG. 2 illustrates a perspective view of the post protector 8. The post protector 8 has a front panel or front 10 with a second panel 12 and third panel 14 attached to opposite edges of the front 10. The three panels thus form a C-shaped cross section. Attached to the front 10 is a flange 16 which extends a distance d outward from the front 10, as illustrated in FIG. 2. The distance d is preferably half an inch. As seen in FIG. 2, the second panel 12 and third panel 14 are not perpendicular with respect to the front 10 but rather are biased inwardly. This angle should be made sufficient to provide a spring pressure against a post when the post protector is in use, but not angled so much that the post protector can not slide onto a post. For example, an angle of 86 to 83 degrees between the panel 12 or 14 and the front 10 would be sufficient. Molding or stamping of the post protector during manufacture can provide for the panels to be slightly angled. The front 10 and two side panels 12 and 14 are preferably sized to fit the sides of the post. Thus, the three panels should have the same width as the sides of the post to be protected. As seen in FIG. 2, the width w of the panel is measured from one panel edge to an opposing panel edge. Thus, for example, if the post is a 4×4 timber, i.e. 3.75×3.75 inches, then the width w of each panel is preferably 3.75 inches. This correspondence allows the panels of the post protector 8 to securely engage the post when installed and completely protect the entire width of the post. The height h of each panel is measured from the top edge of the panel to the bottom edge of the panel, as shown in FIG. 2 with respect to the third panel 14. The height h of each panel is approximately 5 inches. The thickness of each panel is relatively small in comparison to the height h and width w. Though FIG. 2 illustrates that the post protector is a single piece of material, the second and third panels of the post protector may also be separate pieces and attached to the front 10 by a hinge or screw.

FIG. 3 illustrates a front view of the post protector in more detail. Attached to the top edge of the front 10 is a flange 16 which, as described above, extends approximately 0.5 inches outward from the front 10. The flange 16 illustrated is triangular and extends the width w of the top edge of the front 10. The flange may be other shapes and widths which provide a surface extending from the front 10 sufficient in area for applying a downward pressure. The front 10 also comprises a pointed piece 18 attached to the bottom edge of the front 10 such that the pointed piece extends a distance d downward to pierce the surface around the post 4 when the post protector 8 is installed. The distance d is approximately 0.5 inches. The pointed piece 18 may be removably attached. For example, FIG. 3 illustrates perforations 22 between the pointed piece 18 and the front 10 which can be easily cut or torn to remove the pointed piece 18 from the front 10. The pointed piece 18 can thus be removed if a hard surface such as concrete surrounds the post. A nail or screw, inserted through a hole 20 in the front 10, can further secure the post protector 8 to the post.

Referring, now to FIG. 4, the second panel 12 and third panel 14 of the post protector 8 may also be similarly equipped with a flange 16, pointed piece 18, and hole 20 as described with respect to the front 10. As seen in FIG. 4, the front 10 is equipped with a flange **16*a*, a pointed piece 18*a* and a hole 20*a* in the top, center of the front 10, as illustrated in FIGS. 2 and 3. In FIG. 4, the bottom ground engaging edge of the second panel 12 is similarly equipped with a flange 16*b*; the top edge of the second panel 12 is equipped with a pointed piece 18*b*; and the top, center of the second panel 12 is equipped with a hole 20*b*. The third panel 14 is also equipped with a flange 16*c*, a pointed piece 18*c*, and a hole 20*c*. The flanges 16*a*, 16*b* and 16*c*, the pointed pieces 18*a*, 18*b* and 18*c*, and the holes 20*a*, 20*b*, and 20*c* are similar in design and attachment as their respective counterparts shown in FIGS. 2 and 3**.

FIG. 5 illustrates the post protector 8 as normally installed on a fence post 4. To install the post protector 8, the post protector 8 is slipped onto the post 4. The front 10 of the post protector 8 fits across the width of the post 4 and can fixedly engage the post 4 because the width w of the front 10 is preferably the same or slightly longer width than the width of the post 4. Similarly, the second panel 12 and third panel 14 are preferably the same width as the sides of the post 4 and completely cover and protect the width of the sides. The second panel 12 and third panel 14 exert spring pressure against opposite sides of the post 4 to hold the post protector 8 in place. Downward pressure is then exerted by hand or by a hammer against the flange 16 to force the post protector 8 into the ground. The pointed piece 18 facilitates in forcing the post protector 8 through the ground. The post protector 8 is preferably forced about halfway underground such that about 2.5 inches of the height h are above ground and 2.5 inches are below ground. If the surrounding ground is concrete or another hard surface, the pointed piece 18 can be removed before installation so that the bottom edge of the post protector 8 rests against the hard surface. A post protector 8 installed in this manner is described in more detail below with respect to FIG. 7. A screw or nail can then be inserted into the hole 20 in the front 10 to further secure the post protector 8 onto the post 4. In this manner, the post protector 4 is easily installed onto a post in an already constructed fence. In use, the hard metallic or plastic post protector 8 deflects the rotating line of a lawn trimmer from the post 4. When the post protector 8 needs to be removed, the flange 16 may also be used as a handle to lift the post protector 8 from the ground.

Figure 6:
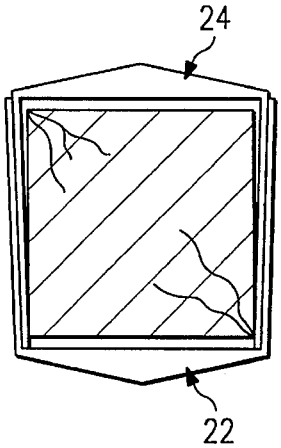
FIG. 6 illustrates a plan view of a first and second post protector of the present invention as normally installed on a free-standing post.

Two post protectors of the present invention may be used in combination to protect a free-standing post. Referring now to FIG. 6, a plan view of a post protected by a first post protector and a second post protector is shown. The front panel 22 of the first post protector is placed against one side of the post while the front panel 24 of the second protector is placed against the opposite side of the post. The second and third panels of the post protectors then overlap each other to surround the entire post.

Figure 7:
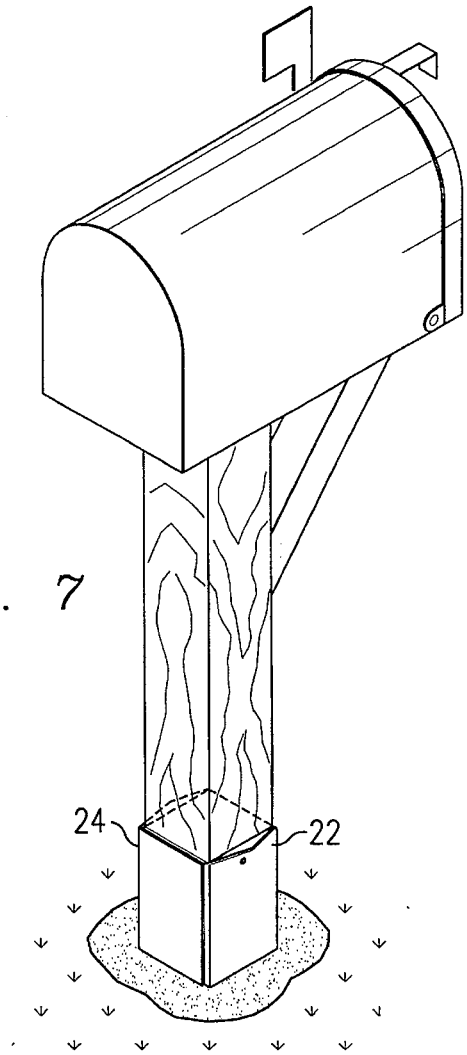
FIG. 7 illustrates a perspective view of a first and second post protector of the present invention as normally installed on a free-standing post.

FIG. 7 illustrates a perspective view of two post protectors used in combination to protect a free-standing post, as in FIG. 6. Since the free-standing post illustrated in FIG. 7 is surrounded by concrete, the post protector is shown without the pointed piece 18. The pointed piece was removed prior to installation, and the entire post protector is aboveground. Of course, it is also possible to use two post protectors to protect a free-standing post in which the pointed piece is not removed, with the post protectors forced into the surrounding ground, as described above.

Figure 8:
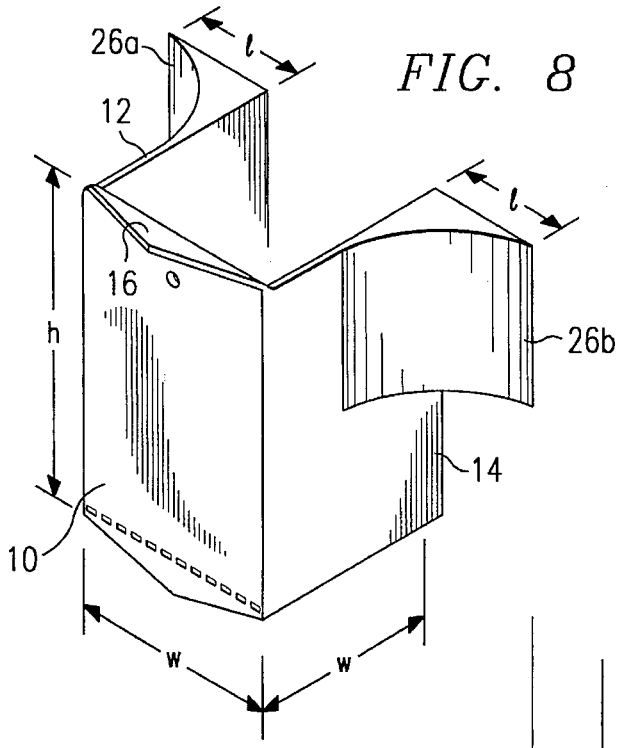
FIG. 8 illustrates a perspective view of a third embodiment of the present invention.
Figure 9:
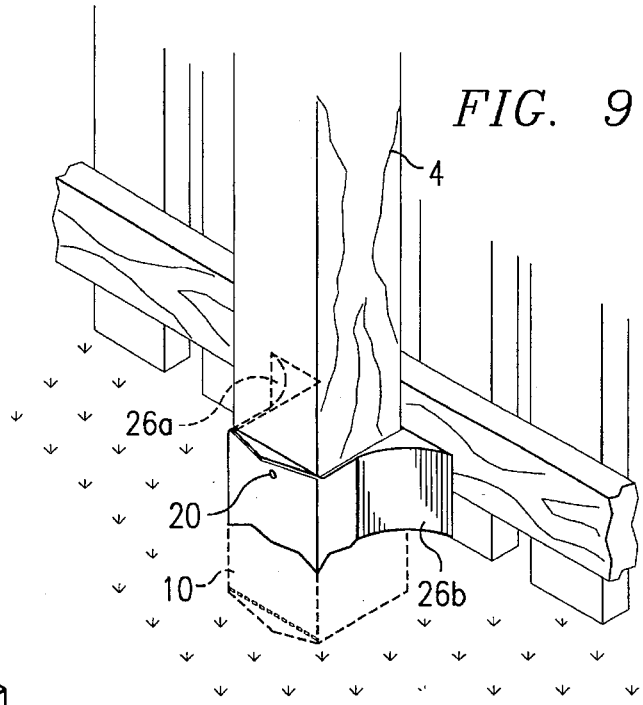
FIG. 9 illustrates a perspective view of the third embodiment as normally installed on a fence post.

Referring now to FIGS. 8 and 9, a third embodiment of the present invention will now be described. In the following description, like reference numerals are used for similar elements. FIG. 8 illustrates a perspective view of the third embodiment of the present invention. Two side moldings **26*a* and 26*b* are attached to the second panel 12 and third panel 14 of the post protector. The side moldings are attached around the center of the height h of each panel and extend to the top edge of each panel. For example, if the side panel is 5 inches in height, the side molding is attached approximately at 2.5 inches height from the bottom, ground-engaging edge and extends to 5 inches height to the top edge. Side molding 26*a* has back part which is perpendicular to the second panel 12 of the post protector. The back part has a length l of approximately 2 inches. The side molding 26*a* has a curved side which extends between the back part to the second panel 12. Similarly, side molding 26*b* has a back part which is perpendicular to the third panel 14 and has a length l of approximately two inches. Side molding 26***b* also has a curved side which extends between the back part to the third panel 14. The side moldings 26*a* and 26*b* are preferably plastice and can be hollow to reduce their cost of manufacture.

FIG. 9 illustrates the post protector with side moldings 26*a* and 26*b* as normally installed. The post protector 8 is forced into the ground until the side moldings 26*a* and 26*b* rest on the surface of the ground. The side moldings 26*a* and 26*b* of the post protector 8 extend outward from the post and cover a portion of the fence boards that are adjacent to the post. In use, the side moldings protect the adjacent fence boards from lawn trimmers, mowers, or clippers. In addition, the moldings prevent build-up of grass clippings in the hard to reach corners around a fence post.

Figure 10:
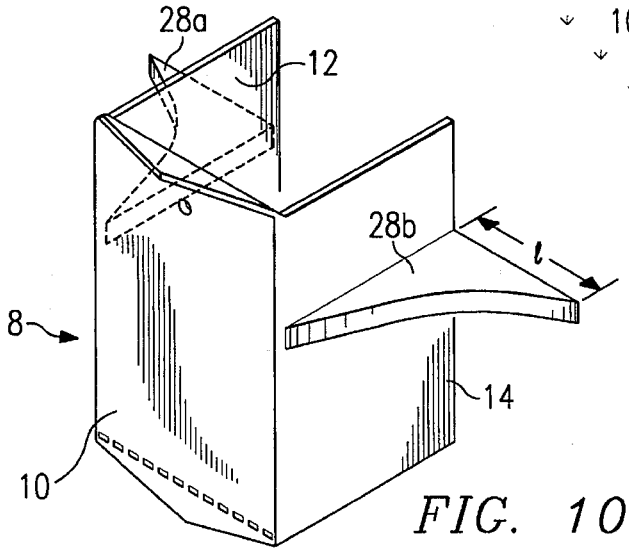
FIG. 10 illustrates a perspective view of a fourth embodiment of the present invention.

Referring now to FIG. 10, another embodiment of the present invention will be described. Again, like numerals, as used hereinabove, are used for similar elements in the following description. In this embodiment, the post protector 8 has side moldings 28*a* and 28*b* attached to the second panel 12 and third panel 14 respectively and are relatively thin in comparison to the height h of the post protector. Preferably, the thickness of the side moldings 28*a* and 28*b* is between a quarter to a half an inch. Side molding 28*a* has a back which extends preferably a length l of two inches outward from the second panel 12 and has a curved side extending between the second panel and the back. Similarly, side molding 28*b* has a back which extends preferably a length l of two inches outward from the third panel 14 and has a curved side extending between the second panel and the back. In use, the post protector is forced into the ground until the side moldings 28*a* and 28*b* rest firmly against the ground. The side moldings 28*a* and 28*b* help prevent grass or other vegetation from growing underneath their surface. In addition, side moldings 28*a* and 28*b* require less plastic than side moldings 26*a* and 26*b*, and thus, the post protector 8 can be constructed with less cost.

The post protector 8 of the present invention thus provides significant advantages. The fitted three panels of the post protector provide complete protection to the exposed sides of a fence post. The post protector is easily installed onto a fence post because it is three-paneled, rather than being circumferential, and can slide onto an installed fence post. Further, because it has three panels, the post protector can be easily placed on a fence post which is already set in the ground. The side panels, which are inwardly biased, also provide significant improvement because the post protector can be installed on the fence post without nails or screws. Finally, the post protector is versatile because it can be used in combination to protect the four sides of a free-standing post.

While the invention has been described herein relative to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

I claim:

1. A fence post protector for protecting a rectangular fence post comprising:

a three-paneled device, wherein each panel of the device is sized to fit a side of the rectangular fence post, said device comprising:

a rectangular front panel;

a rectangular second panel and a rectangular third panel attached to opposite edges of said front panel such that said second panel and said third panel are inwardly biased for exerting spring pressure against opposite sides of the rectangular fence post;

a pointed piece removably attached to a bottom edge of the front panel by perforations between said pointed piece and the bottom edge of the front panel, wherein the perforations allow the pointed piece to be easily removed from the bottom edge of the front panel by tearing or cutting along the perforations; and a flange attached to a top edge of the front panel for exerting downward pressure on the post protector.

2. The fence post protector of claim 1, further comprising a first curved molding attached to said second panel of the fence post protector, wherein a backside of the first curved molding extends outward from the second panel of the fence post protector and a curved side curves inwardly between the backside and the second panel of the fence post protector.

3. The fence post protector of claim 2, further comprising a second curved molding attached to said third panel of the fence post protector, wherein a backside of the second curved molding extends outward from the third panel of the fence post protector and a curved side curves inwardly between the backside and the third panel of the fence post protector.

4. The fence post protector of claim 1, wherein each of said second and third panels has a pointed piece attached to a respective bottom edge.

5. The fence post protector of claim 4, wherein each of said second and third panels has a flange attached to a respective top edge.

6. The fence post protector of claim 1, wherein said front panel further comprises means for further securing the post protector to the rectangular fence post with a screw or nail.

7. A device for protecting a post from deterioration due to damage from lawn tools, said device comprising:

an integrally formed, three-paneled member, said member comprising a front panel, and a second panel and third panel extending from opposite sides of the front panel forming a C-shaped cross section, with the second and third panels inwardly biased for exerting spring pressure against opposite sides of the post;

a flange extending outward from a top edge of the front panel for exerting downward pressure on the device; and a pointed piece removably attached to a bottom, ground engaging edge of the front panel by perforations between said pointed piece and the bottom edge of the front panel, wherein the perforations allow the pointed piece to be easily removed from the bottom edge of the front panel by tearing or cutting along the perforations.

8. The device of claim 7, wherein the front, second and third panels are sized to fit said post having a rectangular cross section.

9. A method of protecting a rectangular post in a constructed fence comprising the steps of:

placing a three-paneled device onto the rectangular post, wherein the three-paneled device comprises a first panel, a second panel and a third panel attached to opposite edges of said first panel such that said second panel and said third panel are inwardly biased to exert a spring pressure against opposite sides of the rectangular post, a pointed piece removably attached to a bottom edge of the first panel by perforations between said pointed piece and the bottom edge of the first panel, wherein the perforations allow the pointed piece to be easily removed from the bottom edge of the first panel by tearing or cutting along the perforations; and a flange attached to a top edge of the first panel;

applying downward pressure to the flange; and fixedly attaching the first panel to the post with securing means.

10. The method of claim 9, wherein the step of fixedly attaching the first panel comprises inserting a nail or screw though a hole formed in the first panel and into the rectangular post.

11. The method of claim 9, wherein the step of applying downward pressure comprises applying downward pressure until the device is substantially halfway implanted in a ground surface surrounding the rectangular post.

12. The method of claim 9, further comprising the step of removing the pointed piece from the first panel of the device and wherein the step of applying downward pressure comprises applying downward pressure until the bottom edge of the device rests on a ground surface surrounding the rectangular post.

13. A fence post protector for protecting a rectangular fence post comprising:

a plastic, three-paneled device, wherein each panel of said device is sized to fit a side of the rectangular fence post, said device comprising:

a front panel;

a second panel and a third panel attached to opposite edges of said front panel, wherein said second panel and said third panel are inwardly biased at an angle in the range of 83 to 86 degrees with the front panel such that said second panel and said third panel are able to exert spring pressure against opposite sides of the rectangular fence post and hold the fence post protector onto the rectangular fence post;

a pointed piece removably attached to a bottom edge of the front panel by perforations between said pointed piece and the bottom edge of the front panel, wherein the perforations allow the pointed piece to be easily removed from the bottom edge of the front panel by tearing or cutting along the perforations; and a flange attached to a top edge of the front panel for exerting downward pressure on the post protector.

14. The fence post protector of claim 13, wherein the front, second and third panels are rectangular.

15. The fence post protector of claim 13, wherein the front panel further comprises means for further securing the post protector to the rectangular fence post with a screw or nail.

* * * * *